United States Patent [19]

Matsubara et al.

[11] Patent Number: 5,021,317

[45] Date of Patent: Jun. 4, 1991

[54] ELECTROSTATIC LATENT IMAGE DEVELOPER WITH TONER PARTICLES SURFACE TREATED WITH A POLYSILOXANE HAVING AMMONIUM SALT FUNCTIONAL GROUPS

[75] Inventors: Akitoshi Matsubara; Jiro Takahashi; Hiroyuki Takagiwa; Hiroya Masaki, all of Hachioji, Japan

[73] Assignee: Konica Corporation, Tokyo, Japan

[21] Appl. No.: 261,741

[22] Filed: Oct. 24, 1988

[30] Foreign Application Priority Data

Oct. 28, 1987 [JP] Japan ..... 62-272516
Oct. 28, 1987 [JP] Japan ..... 62-272517

[51] Int. Cl.[5] ..... G03G 9/097; G03G 13/22

[52] U.S. Cl. ..... 430/110; 430/125; 430/126

[58] Field of Search ..... 430/108, 109, 110, 111, 430/120, 125

[56] References Cited

U.S. PATENT DOCUMENTS 4,640,882 2/1987 Mitsuhashi et al. ..... 430/110
4,828,954 5/1989 Hashimoto et al. ..... 430/110
4,902,570 2/1990 Heinmann et al. ..... 430/110 X

FOREIGN PATENT DOCUMENTS 61-275860 12/1986 Japan ..... 430/110
63-46469 2/1988 Japan ..... 430/109
2144555A 7/1984 United Kingdom .
2177244 1/1987 United Kingdom ..... 430/109

OTHER PUBLICATIONS

Xerox Disclosure Journal, vol. 12, No. 2, Mar./Apr. 1987.

*Primary Examiner*—Roland Martin
*Attorney, Agent, or Firm*—Jordan B. Bierman

[57] ABSTRACT

A developer for developing an electrostatic latent image containing (i) toner particles, (ii) inorganic fine particles of which surfaces are treated by a polysiloxane having an ammonium salt as a functional group, and a developer containing (i), (ii) above and (iii) carrier particles of which surfaces are coated by a resin, and a method of developing an electrostatic latent image by the use of the above developer are disclosed.

18 Claims, 1 Drawing Sheet

ELECTROSTATIC LATENT IMAGE DEVELOPER WITH TONER PARTICLES SURFACE TREATED WITH A POLYSILOXANE HAVING AMMONIUM SALT FUNCTIONAL GROUPS

FIELD OF THE INVENTION

This invention relates to a developer for developing an electrostatic latent image formed in an electrophotographic process, an electrostatic recording process, an electrostatic printing process or the like and, more particularly, to an electrostatic latent image developer suitable for developing a negatively charged electrostatic latent image formed on the surface of an organic photoreceptor.

BACKGROUND OF THE INVENTION

Electrophotography is, as described in U.S. Pat. Nos. 2,297,691 and 2,357,809, for example, to reproduce an image to be in the form of a copied image in such a manner that; an electrostatic latent image of the image is formed on the surface of a photoreceptor; the latent image is transformed into a toner image with a dry type developer comprising colored particles; next, the toner image is transferred to a transfer sheet such as a sheet of paper; and the transferred toner image is permanently fixed by applying heat, pressure or the like; so that a copy of the image may be formed. On the other hand, the photoreceptor from which the toner image was transferred may be reused successively for forming the next images, after the toner remaining on the photoreceptor surface is cleaned up by a cleaning member.

As for the photoreceptors applicable to such an electrophotography as described above, there are well-known photoreceptors including, for example, inorganic photoreceptors such as those of a selenium, zinc oxide, cadmium sulfide and so forth, and organic photoreceptors comprising a high or low molecular weight compound such as polyvinyl carbazole and so forth. In the selenium photoreceptors, however, there are some problems such as that a crystallization is apt to occur in the conditions of a high temperature. therefore, the heat resistance is insufficient and the characteristics such as sensitivity are deteriorated, so that images may be degraded to be unsharp. In the zinc oxide or cadmium photoreceptors, the light-sensitive characteristics thereof are apt to be deteriorated faster by exposing images to light and fog is produced, so that an unsharp image may come out and the durability of the photoreceptor is deteriorated and, in addition, the toxicity to human body is blamed thereon.

In contrast to the above, the organic photoreceptors comprising organic semiconductors are desirable photoreceptors, because they have not the above-mentioned defects, but the advantages such as an excellent layer forming property, an inexpensive manufacturing cost, a high sensitivity, a stable durability, an excellent heat resistance, no toxicity to human body and so forth.

As for the electrostatic latent images formed on the surface of the above-mentioned organic photoreceptor, a negatively charged electrostatic latent image is generally used. This is because there are many kinds of photoconductive substances available for making an organic photoreceptor and a high performance may be displayed.

A negatively charged electrostatic latent image formed on the surface of the above-mentioned organic photoreceptor is developed with such a generally known developer as single-and two-component type developers. The former, the single-component type developers, consist of only magnetic toner containing magnetic substances dispersed in the binders thereof, and the latter, the two-component type developers. are comprised of both toners and carriers comprising magnetic particles.

When a development is carried out with such a developer as mentioned above, the toners constituting the developer should be charged to positive polarity that is the reverse polarity of the negatively charged electrostatic latent image formed on the surface of the photoreceptor.

With the purpose of charging the toner to the positive polarity, a positive charge controlling agent may be added, or, in the case of using a two-component type developer, toners may be frictionally charged to positive polarity by making use of selective carriers.

However, simply with a positive charge applied to the toner, excellent images may not stably be provided extending over a long time. To be more concrete, toners are generally charged by rubbing them with other friction-electrifying member. However, when repeating such operation a number of times, the toner components are partially transferred to the friction-electrifying member by the friction, and the toner components stain the friction-electrifying member surface to which a proper frictional charge should be applied. Therefore, it gradually becomes difficult to apply proper frictional charge to the toner and the absolute value of the frictional charge of the toner is lowered thereby, so that fog is apt to be produced and, consequently, the toner durability is deteriorated.

For the purpose of solving the above-described problems. the following attempts have been made.

(1) In Japanese Patent Examined Publication No. 22447-1978 and Japanese Patent Publication Open to Public Inspection (hereinafter referred to as Japanese Patent O.P.I. Publication) No. 6623-1978, there are the descriptions of such an attempt that toners are applied with a positive chargeability by containing inorganic fine particles treated with an aminosilane coupling agent. However, from the results of the studies thereof made by the present inventors, it was proved that, such a developers may be able to display a somewhat good performance only in the initial stage though, the characteristics of the developer are deteriorated as they are repeatedly used a number of times, namely, the chargeability of the toners are apt to be lowered to produce fog or to fly the toners, so that images are stained. Further, in the conditions of a high temperature, the above-mentioned defects become more serious.

(2) In Japanese Patent O.P.I. Publication Nos. 123550-1981 and 34539-1984, there are the descriptions of such an attempt that toners have been tried to be improved on the stabilization of the chargeability thereof, the environmental safety, the durability thereof and so forth by adding silica fine particles, which have been treated with an aminosilane coupling agent independently or in combination with a silane coupling agent, for making the silica fine particles hydrophobic, to the toner. However, from the results of the studies made by the present inventors, it was proved that, because there are a number of hydrophilic Si—OH functional groups present on the surfaces of silica particles not yet treated, the coupling agent reacts with every —OH group, so that all the —OH groups may not be blocked when treating simply with a coupling agent. Further, since the —OH groups remain considerably on the surfaces of silica particles, these attempts have the defects that the influence of humidity may not completely be prevented and no countermeasure may be taken to environmental changes. Namely. in the case of using repeatedly a number of times or in the conditions of a high humidity, fog is produced due to the lowered chargeability and images are stained due to the toner flying.

(3) In Japanese Patent O.P.I. Publication No. 201063-1984, there is the description of an attempt to obtain a durable chargeability stable against the changes in environment by making use of a developer containing silicic acid fine powder treated with silicone oil having amine coupled to the side-chain thereof. However, from the results of the studies thereof made by the present inventors, it was proved that, because a viscous oil substance is applied to the surface of the silicic acid fine powder, the oil substance is apt to adhere to the surface of a photoreceptor, carrier particles and such a friction-electrifying member such as a developer carrying member and so forth, so that stains are apt to produced, cleanliness of the surface of photoreceptor is deteriorated, the frictional chargeability of toners is made instable and, further, the durability of toners is deteriorated.

Further, in the above-mentioned treated silica, an amine type compound is used. According to the studies made by the inventors, however, this usage is not sufficient from the viewpoint of positive chargeability. In the case of adding such a treated silica as mentioned above into toners, the frictional chargeability of the toner of its own is rather lowered, because the chargeability of these silica is lower than that of the toners. In addition to the above, when the toners are stirred together with carrier particles and the like in a developing chamber and are applied with a physical pressure so as to frictionally charge toners, the treated silica remaining on the surfaces of toners is apt to transfer to other friction-electrifying members to stain such members, therefore, the chargeability of the toners are deteriorated. In such a developer as mentioned above, the adhesion force generated by Coulomb energy between toner particles and carrier particles is lowered to make toners fly into a copying machine, so that images are also stained. Further, silica fine particles treated with a conventional amine compound are apt to disturb the chargeability of toners. Therefore, the frictional electrification efficiency is relatively low. With such a developer, a good performance may probably be achieved in the initial stage of starting the first operation though, in the initial stage of resuming a further coying operation some time after a series of continuous operations were done, a charging rate is slow in getting started. When resuming a copying operation, therefore, an image is fogged and toners are flown about. This phenomenon will be more serious in the conditions of a high humidity where the leakage of charge is apt to occur.

When the present inventors applied the above-described treated silica to an image forming process in which a cleaning is made with a cleaning blade, it was found that, no cleaning trouble occurred in the initial stage though, but the trouble was apt to occur as copying frequency is increased more.

Especially when such a treated silica was applied to an organic photoreceptor, it was found that the conventional treated silica was apt to adhere strongly to the surface of the photoreceptor, because the surface of the photoreceptor contained resin components and, therefore, that a cleaning trouble was raised by the adhesion. Particularly because of the fact that such a component as talc, which was contained in transfer paper, also adhered to the surface of the photoreceptor, the treated silica and the above-mentioned components together produced an adherent matter cohered to the surface of the photoreceptor. Therefore, an electrotype static latent image forming function is lost from the cohesive areas of the photoreceptor surface, so that an image may not satisfactorily be formed, so that a faded and unsharp image, that is so-called 'a vignetted image', comes out and, at the same time, a cleaning trouble is also raised, because such a cohered adhesive matter may not be cleaned up by a cleaning blade.

As described above, in the case of using a conventional surface-treated silica, the following defects are involved; (1) A satisfactorily stable positive-charge may not be applied in coping with the changes in environment; (2) The charging efficiency is low and the initial chargeability is slow in getting started; (3) A cleaning trouble is apt to occur; (4) The durability is deteriorated; and so forth.

In the conventional type developers, it has been hard to produce fine and flexible magnetic brushes. Therefore, the developability thereof is low and a development may not be achieved unless a latent image is rubbed rather forcibly with a magnetic brush. Accordingly, there have been the defects that a toner image which was developed once is rubbed with a magnetic brush and thereby the traces of the magnetic brush are produced on the image (that is a phenomenon of producing white streaks in the direction of rubbing the toner image with the magnetic brush); thereby a blurry image phenomenon is produced so as to trail black-lines from the trailing edge of the image; or thereby the gradation reproducibility and resolving power of an image are deteriorated. The above-described phenomena will be more serious if the fluidity of a developer is further lowered in the conditions of a high humidity.

SUMMARY OF THE INVENTION

It is, therefore, an object of the invention to provide a developer for developing an electrostatic latent image which is less liable to stain the surface of a friction-electrifying member, and which has excellent durability, so that a stable chargeability can be retained for a long period of time.

Another object of the invention is to provide a developer for developing an electrostatic latent image which is less likely to produce fog or to be scattered in the copying apparatus even under conditions of high temperature and high humidity, which has improved durability, capable of giving sharp and clear images for a long period of time, and which has improved stability and resistivity against any change in the environmental conditions.

A further object of the invention is to provide an electrostatic latent image developer capable of producing sharp and clear images, whose chargeability is excellent in getting started upon resumption of copying operation after an interruption under high humidity, without causing fog or toner scattering.

A still further object of the invention is to provide an electrostatic latent image developer which has excellent cleaning property, so that the surface of a photoreceptor or a cleaning blade is hardly affected by filming or damaged.

Another object of the invention is to provide an electrostatic latent image developer which is capable of providing excellent images which is less likely to receive any scratch marks or a blurry copy, but has excellent gradation and resolving power, as well as an excellent image stability extending over a long period of time.

These and other objects of the invention will become apparent from the following description.

The present invention specifically relates to a developer for developing an electrostatic latent image comprising (i)toner particles, and (2)0.1 to 5% by weight relative to said toner particles of inorganic fine particles of which surfaces are treated by a polysiloxane having an ammonium salt as a functional group.

The present invention also relates to a method for forming a toner image which comprises steps of; forming a toner image by developing an electrostatic latent image on an photoreceptor with a particulate developer, transferring said toner image to transfer paper, and scraping away the remaining toner on the photoconductor, wherein said particulate developer comprises (i)toner particles, and (ii)0.1to 5% by weight relative to said toner particles of inorganic fine particles of which surfaces are treated by a polysiloxane having an ammonium salt as a functional group.

Figure 1:
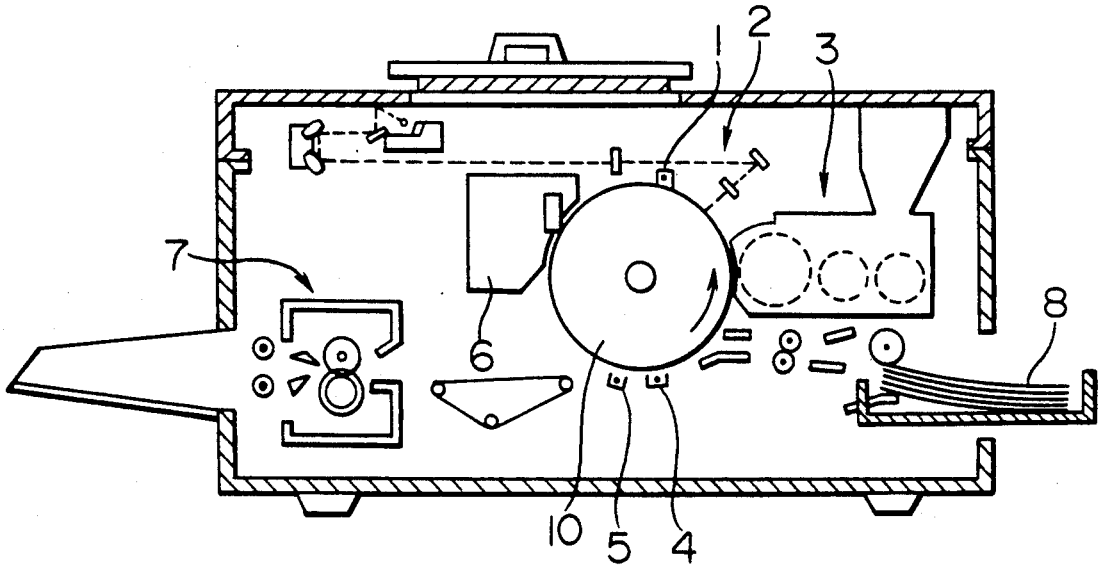
FIG. 1 is a sectional view of an example of image forming apparatuses capable of suitably performing an image formation by making use of the developer of the invention.

In the figure, the reference numerals indicate the following, respectively.

1 ... Corona charger,
2 ... Optical exposure system,
3 ... Magnetic brush developing unit,
4 ... Electrostatic transferring unit.
5 ... Separating unit,
6 ... Blade type cleaning unit,
7 ... Heat-roller fixing unit.
8 ... Transfer paper, and
10 ... Organic photoreceptor.

DETAILED DESCRIPTION OF THE INVENTION

According to the present invention, a developer having improved positive chargeability, moisture resistance and durability can be obtained by using in a developer inorganic fine particles of which are surface-treated with polysiloxane having an ammonium salt as the functional group. The ammonium salt as a functional group can have relatively higher positive-charge density than an amino group, and for this reason it can provide a high positive chargeability to toner particles.

Further, owing to the inorganic particles having an ammonium salt structure, the viscosity and adhesion of developer may be reduced and thus adhesion to or staining of a friction-electrifying member may effectively be prevented.

By the use of a polysiloxane polymer, the surfaces of inorganic fine particles may be covered therewith more evenly than in the case of a monomer coupling agent, and thus a number of hydrophobic sites and negatively charged sites, such as —OH group, which are originally present on the surfaces of inorganic particles, can be reduced, so that a high positive-chargeability can be provided even under high humidity condition.

Further by the use of the developer of the invention, in which the above-mentioned inorganic fine particles of the invention have been adhered to toner surfaces, when the developer is stirred in the developer unit for the purpose of making the mixture ratio of toner and carrier as well as the frictional charge to the toner uniform, transfer and adhesion of the inorganic fine particles to the inner wall, development sleeve, a regulating blade and so forth can effectively be prevented, so that stable positive-chargeability even after a number of times of image forming processes can be retained. Further, since the developer is endowed with improved fluidity by the inorganic fine particles, the cohesion of developer particles can also be prevented, so that they stable frictionally charge of the toner may be secured. Resultingly, highly efficient and faster frictional charging can be achieved even after a copying operation is interrupted and fogging and toner-flying may be prevented.

Besides the above, the inorganic fine particles which is relatively less adhesive and softer, prepared by applying a polysilocane having an ammonium salt as a function group, reduced amount of adhesion to the surface of an organic photoreceptor, which is relatively liable to be filmed, may be observed, and even if they adhere to the surface, they may readily be removed form the surface by, for example, using a cleaning blade.

The toner particles comprising the inorganic fine particles of the invention adhered to the surface thereof, since they are brought into contact with the surface of the photoreceptor through the less adhesive inorganic fine particles, so that the toner particles may be prevented from filming on the surface of the photoreceptor.

Also, since adhesion of the toner particles to the surface of the photoreceptor can be reduced, the cleaning property will be improved relative to conventional toners, and the toner, if remained on the surface of the photoreceptor, may easily be cleaned by a cleaning blade. Further, since the inorganic fine particles adhered to the surfaces of toner can prevent both surfaces of the carrier and the photoreceptor from being stained by the toner, changing in its composition and deterioration in its properties may be prevented and, thus, it becomes possible to provide a developer with improved durability.

Further by the use of the developers of the invention, a negatively charged electrostatic latent image formed on the surface of an organic photoreceptor can advantageously be developed, without spoiling the advantages of the organic photoreceptors, such as less manufacturing cost and no toxicity, without causing toner scattering or cleaning trouble. Particularly, because the improved fluidity of the developer makes it possible to form a uniform magnetic brush of a developer on a developing sleeve, so that the developer of the present invention can preferably be used in the magnetic brush development.

According to the most preferable embodiment of the present invention, the developer contains a resin-coated carrier. The surface of such resin-coated carrier may preferably be smoothened by applying a coat, so that the carrier does not become stained by toner components or inorganic fine particles and a highly durable developer may be obtained. Further, when both the inorganic fine particles and the resin-coated carrier are used together, a developer having an excellent fluidity even in the conditions of high temperature and humidity can be obtained by the synergistic effects of the inorganic fine particles having a small adhesion and the resin coated carrier surface having low surface energy and the lowered friction coefficiency, so that formation of a fine and soft magnetic brush becomes possible.

Thus according to the most preferable embodiment of the present invention, (1) the charging efficiencies of both toner and carrier may be improved, which makes a developer faster in getting charged even after a copying operation is interrupted; (2) a phenomenon of scraping toner images may be prevented by making use of a soft magnetic brush, so that a scratch marks may be prevented from occurring and a blurry image may also be prevented; (3) by the use of an elaborately prepared developer, development capable of performing a development corresponding to the surface potential of a photoreceptor and displaying an excellent gradation; and (4) by the use of the inorganic fine particles and the resin-coated carriers together, accidental production of toner which is chargeable in the opposite polarity may be prevented to the utmost probability, so that application of uniform charge to the toner becomes possible. Therefore, when the finely prepared developer as mentioned above is used, images having excellent resolving power without adhesion of toner in the non-image portion of the interfacial area between a non-imaged area and an imaged area.

The polysiloxanes having an ammonium salt as the functional groups thereof are used in the inorganic fine particles of the invention. The preferable polysiloxanes include, for example, dimethylpolysiloxane having an ammonium salt group which is high in positive chargeability and hard to cause a cleaning trouble. The dimethylpolysiloxanes having an ammonium salt group include, generally, a dimethylsiloxane containing the component unit represented by the following Formula (A). These dimethylsiloxanes may be represented by the following Formula (B). for example.

Formula (A)

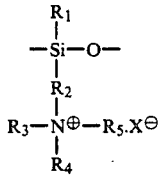

wherein $R_1$ represents a hydrogen atom, a hydroxy group, an alkyl group, an aryl group, an alkoxy group or

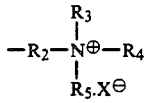

$R_2$ represents a linkage group such as an alkylene group, an arylene group, an aralkylene group, —NH—, —NH-CO— or any one of the combination thereof, or a simple link; $R_3$, $R_4$ and $R_5$ represent a hydrogen atom, an alkyl group or an aryl group. respectively; X represents a halogen atom; and each of the groups represented by $R_1$ through $R_5$ includes those having a substituent.

Formula (B)

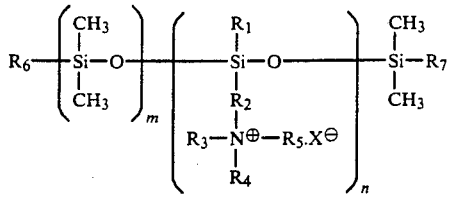

wherein $R_6$ and $R_7$ represent a hydrogen atom, a hydroxy group, an alkyl group, an aryl group or an alkoxy group, and these groups include those having a substituent, respectively; $R_1$ through $R_5$ and X are synonymous with those denoted in the above-given Formula (A), respectively; and m and n are an integer of not less than 1.

Further,

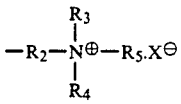

include, typically, those represented by the following Formula, to which the invention shall not be limited.

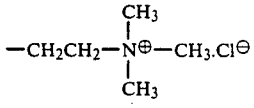
(1)

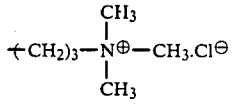
(2)

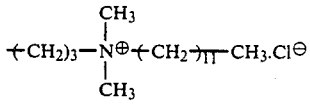
(3)

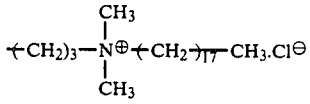
(4)

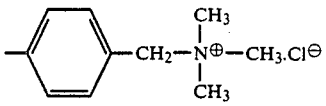
(5)

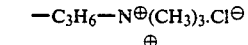
(6)

(7)

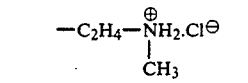
(8)

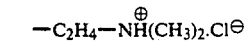
(9)

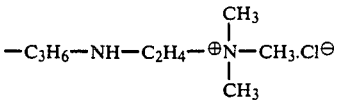
(10)

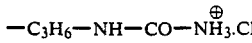
(11)

-continued

(12) $-C_3H_6-\overset{\oplus}{N}H_2\overset{Cl^\ominus}{}-C_2H_2-COOC_2H_5$

(13) $-C_3H_6-\overset{\oplus}{N}H(C_2H_5)(CH_3).Cl^\ominus$

(14) 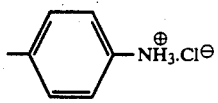

(15) 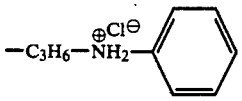

(16) 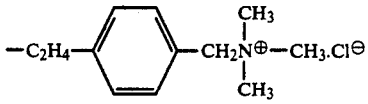

(17) 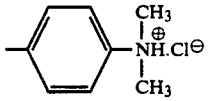

(18) $-C_3H_6-\overset{\oplus}{N}H(C_2H_4-OH)(C_2H_4OH).Cl^\ominus$

(19) 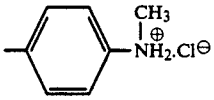

Polysiloxanes having an ammonium salt as the functional group thereof may be obtained in, for example, such a method that an organohalogenated silane having an ammonium salt as the functional group thereof and the other organohalogenated silane not particularly having an ammonium salt group are copolymerized in the polymerizing stage, so that the objective polysiloxane may be introduced thereby; such a method that a polysiloxane is obtained by polymerizing with an organohalogenated silane and is then partially denatured with an organic group having an ammonium salt as the functional group thereof; and so forth. Wherein an organoalkoxysilane may be used in place of the organohalogenated silane. Further, some of the compounds thereof may be available on the market.

The inorganic fine particles which may be surface-treated with a polysiloxane having an ammonium salt as the functional group thereof include, for example, the fine particles of silica, alumina, titanium oxide, barium titanate, magnesium titanate, calcium titanate, strontium titanate, zinc oxide, chromium oxide, cerium oxide, antimony trioxide, zirconium oxide, silicon carbide and so forth. It is preferable that the primary particles of such inorganic fine particles, that is, the particles being in the state where they are separated into individual unit particles, should have an average particle size within the range between 3 mμm and 2 μm.

As for the inorganic fine particles, silica fine particles, in particular, may preferably be used from the viewpoint of improving the fluidity. Such silica fine particles are those having a Si—O—Si bond and may be prepared in any one of dry methods and wet methods, however, those prepared in a dry method should preferably be used and, particularly, silica fine particles produced in the vapor-phase oxidation of a silicon halide should more preferably be used. The silica fine particles may also be the fine particles of a silicate such as aluminium silicate, sodium silicate, calcium silicate, potassium silicate, zinc silicate, magnesium silicate and so forth, besides silicon dioxide (silica) and, among them, those containing $SiO_2$ in a proportion of not less than 85% by weight should preferably be used.

As for the methods of treating the surface of inorganic fine particles with a polysiloxane having the above-mentioned ammonium salt as the functional group thereof, any well-known methods may be used. For example, there may be given the following methods. Namely, one method is that inorganic fine particles are dispersed in a solution of the above-described polysiloxane dissolved in a solvent and the solvent is removed by a filtration or in a spray-dry method and the resulted matter is dried up and hardened with heating: the other method is that the above-described polysiloxane is dissolved in a solvent and the resulted solution is spray-coated to inorganic fine particles by making use of a fluidizing-bedding apparatus and the coated particles are then dried up with heating so as to remove the solvent, so that a coat is formed; and the like methods.

In the particle sizes of the prepared inorganic fine particles of the invention, an average particle size of the primary particles should preferably be within the range of from 3 mμm to 2 μm and, particularly, from 5 mμm to 500 mμm. According to a BET method, the specific surface area should preferably be within the range of from 20 to 500 $m^2/g$. When such an average particle size is too small or when such a specific surface area is too large, there may be some instances where a cleaning trouble may be caused, because, when cleaning with a blade-type cleaning device, for example, inorganic fine particles are apt to graze along the cleaning blade. On the other hand, when the average particle size is too large or when the specific surface area is too narrow, the fluidity of a developer may be so lowered as to make chargeability unstable. Resultingly, there may be some instances where the durability of the developer may be deteriorated.

When preparing a developer by making use of the above-mentioned inorganic fine particles of the invention, —such inorganic fine particles of the invention are added from the outside into powdered toner particles and then mixed up together. Then, the inorganic fine particles of the invention are so contained as to adhere to the surface of the toner particles and, further, carriers and so forth are mixed therein.

The content of the above-mentioned inorganic fine particles of the invention should preferably be from 0.1 to 5% by weight of the toner used and, more preferably, from 0.1 to 2% by weight. When the content of the above-mentioned inorganic fine particles of the invention is too small, there may be some instances where the fluidity of developer may be lowered and, resultingly, the friction-electrification of the toner may be deteriorated to make the toner difficult to be applied with a proper positive charge capacity, so that there may be some instances where fog may be produced. On the other hand, when the content of the above-mentioned inorganic fine particles of the invention is too much, there may be some instances where the inorganic fine particles of the invention may be partially present in such a state that they may be free from the toner particles and, resultingly, the inorganic fine particles of the invention may adhere or transfer to carrier particles or may adhere to or accumulate on the inner walls of a developing unit, a developing sleeve. a regulating blade and so forth, so that the friction-electrification of the toner may be deteriorated in its early stages to make the toner difficult to be applied with a proper positive charge capacity and, therefore, there may further be some instances where fog may be produced and image density may also be lowered.

The above-mentioned toner is powdered particles comprising a binder resin containing a coloring agent and other additives. Normally, an average particle size of such toner is preferably of the order of from 5 to 20 μm. The other additives than the above include, for example, a fixability improving agent, a charge controlling agent, a cleaning property improving agent and so forth.

The binder resins of such toner is not limited and, any resins having been generally applicable to this kind of use may be used. They include, typically, a polystyrene-type resin, (a styrene-acryl-type copolymeric resin), a poly-styrene-butadiene resin, a polyester resin, an epoxy resin, and so forth. Among them, the polystyrene-type resin, (preferably a styrene-acryl type copolymeric resin), and polyester resin may preferably be used for those capable of making toner chargeability stable.

The typical examples of styrene type monomers applicable for obtaining the above-mentioned polystyrene type resins include styrene, o-methylstyrene, m-methylstyrene, p-methylstyrene. α-methylstyrene, p-ethylstyrene, 2,4-dimethyl-styrene p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene and so forth. These monomers may be used independently or in combination.

The polyester resins are used for the binder resins of toners and they may be prepared through the condensation-polymerization of polyhydric alcohol and polyhydric carboxylic acid.

Such polyhydric alcohols include, for example, diols such as ethylene glycol, diethylene glycol, triethylene glycol, 1,2-propylene glycol, 1,3-propylene glycol, 1,4-butanediol, neopentyl glycol, 1,4-butenediol and so forth; etherified bisphenols such as 1,4-bis(hydroxymethyl)cyclohexane, bisphenol A, hydrogenated bisphenol A, polyoxyethylenified bisphenol A, polyoxypropylenified bisphenol A and so forth: and other divalent alcohol monomers.

The polyhydric carboxylic acids include, for example, maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, the anhydrates thereof, dimers of a lower alkylester and linolenic acid, and other divalent organic acid monomers.

The polyester resins applicable to the binder resins include, suitably, not only the polymers consisting of the above-given bifunctional monomers only, but also the polymers containing a component comprising trifunctional or more multifunctional monomers.

The polyhydric alcohols having trivalency or more valency, which are the above-mentioned multifunctional monomers, include, for example, sorbitol, 1,2,3,6-hexanetetrol, 1,4-sorbitan, pentaerythritol, cane Sugar, 1, 2, 4-butanetriol, 1, 2, 5-pentanetriol, glycerol, 2-methyl-propanetriol, 2-methyl-1,2,4-butanetriol, trimethylolethane, trimethylolpropane, 1,3,5-trihydroxymethylbenzene, etc.

The polyhydric carboxylic acid monomers having a trivalency or more valency include, for example, 1,2,4-benzenetricarboxylic acid, 1,2,5-benzenetricarboxylic acid, 1,2,4-cyclohexanetricarboxylic acid, 2,5,7-naphthalenetri-carboxylic acid, 1,2,4-naphthalenetricarboxylic acid, 1,2,4-butanetricarboxylic acid, 1,2,5-hexanetricarboxylic acid, 1,3-di-carboxyl-2-methyl-2-methylenecarboxylpropane, tetra(methylenecarboxyl)methane, 1,2,7,8-octanetetracarboxylic acid. Empol trimeric acid, the hydrates thereof, etc.

The coloring agents include, for example, dye stuffs, pigments or the like, such as carbon black, phthalocyanine blue, benzidine yellow, Nigrosine dye, aniline blue, chalcoil blue, chrome yellow, ultramarine blue, Du-Pont-Oil red, quinoline yellow, methylene blue-chloride. Malachite green oxalate, lamp black. Rose Bengale, etc.

The charge controlling agents include, for example, a Nigrosine dye, a metal complex type dye, an ammonium salt type compound, an aminotriphenylmethane type dye, an N-atom-containing polymer, etc.

The fixability improving agents include, for example. polyolefins such as polyethylene, polypropylene and so forth, a fatty acid metal salt, a fatty acid and a fatty acid ester type wax, a higher fatty acid, a higher alcohol, a fluid or solid paraffin wax, an amide type wax, a polyhydric alcohol ester, a silicone wax, an aliphatic fluorocarbon, etc.

The cleaning property improving agents include, for example, fatty acid metal salts such as zinc stearate, calcium stearate, stearic acid and so forth, polymer finer particles such as those of methylmethacrylate, styrene, etc.

As for the resin-coated carriers constituting a developer applicable to the invention, those having a variety of constitution may be used. Typically, they include, preferably, a resin-coated carrier whose magnetic particle surfaces are treated with a silicone type resin or a fluorine type resin.

The compounds preferably applicable to the resin-coated carrier include, for example, silicone resins such as silicone varnish, silicone rubber, silicone resin, the hardened matters thereof and so forth; and fluorine type resins such as a fluorovinylidene-tetrafluoroethylene copolymer, tetrafluoroethylene, a methylmethacrylatemethacrylic acid-1,1-dihydroxyparfluoroethyl copolymer, a styrene-methacrylic acid-1,1,3-trihydroxyparfluoro-n-propyl copolymer, and so forth. The above-given substances may be used independently or in suitable combination.

In the resin-coated carrier prepared with the above-mentioned silicone type resins or fluorine type resins, the surface energy thereof becomes considerably lower and. resultingly, toner substances or positive-chargeable inorganic fine particles are so hard to adhere or transfer to the carrier particles that the staining of the carriers may be inhibited, so that an excellent developer having a remarkable durability may be obtained.

The silicone type resins include, preferably, those having an organic group such as an aromatic group or the like and, particularly, those having such an organic group as a methyl group, a phenyl group and so forth.

The typical examples of the compounds from which the silicone type resins having the above-mentioned organic group may be obtained include, preferably, dimethylpolysiloxane, methylphenylpolysiloxane, diphenylpolysiloxane, the denatured matters thereof, and so forth. The polysiloxane having a methyl or phenyl group, in particular, has an excellent negative-chargeability. Therefore, when frictionally charging toners and the resin-coated carrier obtained by using this type polysiloxane, the toner may be applied with an excellent positive frictional charge. When suitably selecting the content of the methyl or phenyl group in the above-mentioned organic group, the characteristics of the carrier, such as the hardness of the coating, the strength, the friction electrification and so forth may be adjusted thereby. Accordingly, the requirements for the toner being used together with the above-mentioned resin-coated carrier may be eased to a considerable extent, so that there may be such an advantage that the range of selecting toner may be widened.

The following silicone varnishes are available on the market. Namely. SR2101, SH997, SH994, SR2202, SE9140, SH643, SH2047, JCR6100 and JCR6101(each manufactured by Toray Silicone Co.: KR271, KR272, KR274, KR216, KR280, KR282, KR261, KR260, KR255, KR266, KR251, KR155, KR152, KR214, KR220, X-40-171, KR201, SA-4, KR5202, KR3093and EC1001(each manufactured by Shinetsu Chemical Industrial Co.: and so forth.

The following silicone rubbers are available on the market. Namely, SH410, SH432, SH433, SH740, SH35U, SH75U, SH841U, SH1125U, SH1603U, SH665U, SE955U, SH502U and SRX-440U (each manufactured by Toray Silicone Co.; and so forth.

The fluorine type resins for forming the coating layers of the carriers shall not specially be limitative, provided that they are any resins containing fluorine atom. Among them, the preferably applicable ones include, for example, a polymer polymerized with the monomers represented by the following Formula (1) or (2), a vinylidene fluoride-ethylene tetrafluoride copolymer and so forth.

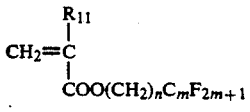

Formula (1)

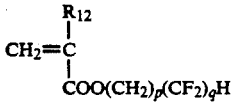

Formula (2)

wherein $R_{11}$ and $R_{12}$ represent a hydrogen atom or a methyl group, respectively: n and p are an integer of from 1 to 8, respectively; and m and q are an integer of from 1 to 19, respectively.

Among the monomers represented by the above-given Formula (1) or (2), the monomers represented by the following Formula (3) or (4) are more preferable from the viewpoint of friction electrification.

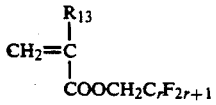

Formula (3)

-continued

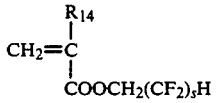

Formula (4)

wherein $R_{13}$ and $R_{14}$ represent a hydrogen atom or a methyl group, respectively; r is an integer of 1 or 2; and s is an integer of from 2 to 4.

Among the monomers represented by the above-given Formula (1) or (2), the following monomers, in particular, may preferably be used. Namely, methacrylic acid-1,1-dihydroparfluoroethyl, methacrylic acid-1,1,3-trihydro-parfluoro-n-propyl and so forth.

When using the vinyl fluoride-ethylene tetrafluoride copolymer, the mole percentage of these copolymers should preferably be within the range of from 72:25to 95:5 and, more preferably, within the range of from 75:25 to 87.5:12.5. When preparing a coating solution for forming a coating layer by making use of these copolymers having the above-given mole percentage, they may readily be soluble in a solvent, so that the coating solution may also readily be prepared and the resin-coated carriers having both of a great mechanical strength of the coating layer obtained and an excellent durability may be obtained.

The substances having the following formulas may be given as the typical examples of the fluorine type resins. It is, however, to be understood that the invention shall not be limited thereto. In the following formulas, a and b respectively are integer of not less than 1.

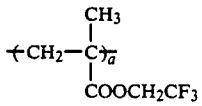

(1)

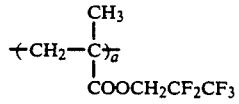

(2)

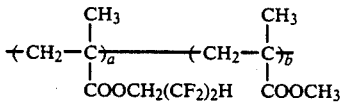

(3)

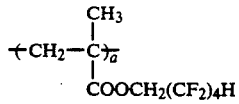

(4)

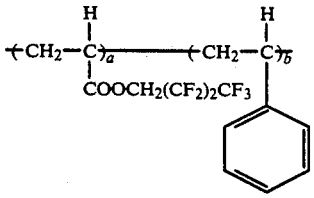

(5)

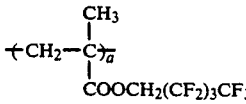

(6)

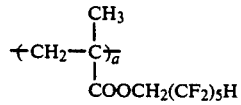

(7)

-continued

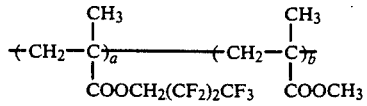

(8)

Particularly when using the fluorine type resin-coated carrier, they have an excellent effect to positively charge toner and the toner may not necessarily contain any charge controlling agent which is one of the causes for staining carrier, therefore, a developer may be so prepared as to have a remarkably high durability.

As for the magnetic particles constituting carrier, there may be used the particles of a substance which is strongly magnetized by a magnetic field in the direction of the magnetic field. Such particles include, for example, those of iron, ferrite, magnetite, metals or the alloys thereof capable of showing a ferromagnetism such as iron, nickel, cobalt and so forth, the compounds containing the above-given elements, or the like. In particular, ferrite particles which do not fly are preferably be used.

There is no special limitation to the preparation processes of resin-coated carrier, such resin-coated carrier may be prepared in such a manner, for example, that a coating solution is prepared by dissolving the coating components and, if required, a setting agent or the like applicable thereto, in a solvent, so as to be applied to the surfaces of magnetic particles, and the solvent is then volatilized off by drying the particles with heating and, if required, the coated layers are thermoset.

There is also no special limitation to the coating methods. The coating methods applicable thereto include, for example, a dipping method in which powdered magnetic particles are dipped into a coating solution; a spray method in which magnetic particles are sprayed with a coating solution; a fluidized bedding method in which magnetic particles are suspended by blowing fluidized air and a coating solution is sprayed to the magnetic particles being suspended; and so forth.

The solvents applicable to the above-mentioned coating solutions include, for example, toluene, xylene, acetone, methylethyl ketone, tetrahydrofuran, dioxane, a higher alcohol, the mixed solvents thereof, and so forth.

The average particle size of the carrier is preferably from 20 to 200 μm and more preferably from 40 to 150 μm. When the average particle size of the carrier is too small, the so-called carrier-adhesion phenomenon is produced, because the carrier adhere to an electrostatic latent image to form the fixed image thereof. Resultingly, there may be some instances where an image may be unsharp. On the other hand, when the average particle size of the carrier is too large, there may be some instances where an image unevenness may be produced. An average particle size of carrier interms of weight is a value measured by making use of a 'Microtrack' manufactured by Nikkiso Co.

For the image formation using the developer of the invention, the preferably applicable organic photoreceptors are constituted in such a manner that a photoreceptive layers each containing a photoconductive semiconductor comprising an organic compound dispersed in a resin binder, such photosensitive layer is laminated over to a conductive support comprising, for example, aluminium, stainless steel or the like.

As for the photoreceptive layer, a separate function type photoreceptive layer is preferably used from the viewpoint of improving a resolving power. The separate function type photoreceptive layer is comprised of the combination of a carrier generating layer and a carrier transport layer. The carrier generating layer is comprised of a carrier generating substance capable of generating charged carriers upon absorption of visible rays of light, including, for example, an anthanthrone type compound, a perylene type derivative, a bisazo type compound, a phthalocyanine type compound and so forth, such substance is dispersively contained in such a binder resin as a styrenemethylmethacrylate copolymer, a polycarbonate resin, a silicone resin and so forth; and the carrier transport layer containing a carrier transport substance including, for example, an oxydiazole derivative, a triarylamine derivative, a polyarylalkane derivative, a hydrozone derivative, a stilbene derivative, a styryltriarylamine derivative and so forth, each capable of transporting the carriers having been produced in the carrier generating layer.

Next, the image formation process, in which the developer of the invention is used, will now be described.

FIG. 1 illustrates an example of image forming apparatuses suitably applicable for performing the image formation in which the developer of the invention is used.

Wherein, reference numeral 10 indicates an organic photoreceptor for forming an electrostatic latent image. This organic photoreceptor 10 is of a rotary-drum type. Around the organic photoreceptor 10, there are arranged in order of corona-charger 1, optical exposure system 2, magnetic brush 3, electrostatic transferring device 4, sperating device 5 and blade-type cleaning device 6, from the upper stream side to the down stream side with respect to the direction of rotating the photoreceptor.

In the above-mentioned apparatus, the surface of organic photoreceptor 10, which is subject to a development, is so charged as to have a uniform potential by corona charger 1, and is then exposed imagewise to light through optical exposure system 2, so that an electrostatic latent image corresponding to an original document may be formed on the surface of organic photoreceptor 10, which is subject to the development. The electrostatic latent image is developed by developing unit 3, so that a toner image corresponding to the original document may be formed. The toner image formed on organic photoreceptor 10 is transferred to transfer paper 8 by electrostatic transfer unit 4 and the toner image on transfer paper 8 is fixed with heating by heat-roller type fixing unit 7, so that a fixed image may be formed. On the other hand, organic photoreceptor 10 passes through electrostatic transfer unit 4 and the surface thereof is rubbed by blade type cleaning unit 6 and, thereby, the toners remaining on the surface of the photoreceptor are scraped away, so that the surface may be cleaned up as it was so as to make it ready to be charged again by corona charger i.

EXAMPLES

Now, the examples of the invention and the comparative examples will be described below. It is, however, to be understood that the invention shall not be limited to such examples as described below.

(Preparation of Inorganic Fine Particles)

(1) Inorganic fine particles (for the Invention)

As the component unit of the inorganic fine particles, polysiloxane containing the following ammonium salt as the functional group was dissolved in xylene, so that a processing solution was prepared.

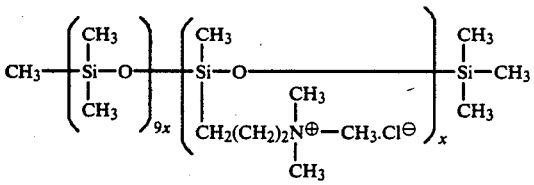

(wherein x is an integer)

Next, silica fine particles, 'Aerosil 200' manufactured by Nippon Aerosil Co., were put into a mixer and, thereto. the above-described siloxane was so sprayed as to be in a proportion of 5% by weight. After then, the resulted silica fine particles sprayed with siloxane were put into a flask and the xylene, i.e., the solvent, was removed by heating at 200° C. with stirring for 5 hours, so that inorganic fine particles surface-treated with polysiloxane containing an ammonium salt as the functional group were obtained.

The resulted inorganic fine particles are named 'Inorganic fine partiles A'. In the resulted inorganic fine particles A, the average particle size of the primary particles was 12 mμm and the specific surface area thereof obtained in a BET method was 115 $m^2/g$.

(2) Inorganic fine particles B (for the invention)

As the component unit of the inorganic fine particles, polysiloxane containing the following ammonium salt as the functional group was dissolved in xylene, so that a processing solution was prepared.

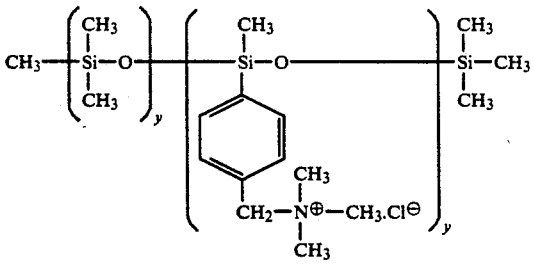

(wherein y is an integer)

Next, the surface-treated inorganic fine particles were obtained in the same manner as in the preparation of inorganic fine particles A, except that silica fine particles, 'Aerosil 300' manufactured by Nippon Aerosil Co., were put into a mixer and, thereto, the above-described polysiloxane was so sprayed as to be in a proportion of 17% by weight. The resulted fine particles were named 'Inorganic fine particles B'. In the inorganic fine particles B, the average particle size of the primary particles was 7 mμm and the specific surface area thereof obtained in a BET method was 126 $m^2/g$.

(3) Inorganic fine particles C (for the Invention)

Polysiloxane containing the following ammonium salt as the functional group was dissolved in xylene, so that a processing solution was prepared.

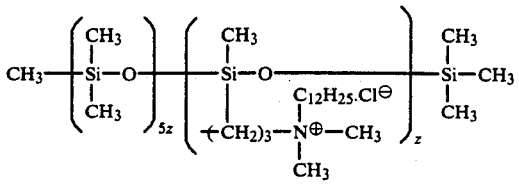

(wherein z is an integer)

Next, the surface-treated inorganic fine particles were obtained in the same manner as in the preparation of inorganic fine particles A, except that silica fine particles, 'Aerosil 200' manufactured by Nippon Aerosil Co., were put into a mixer and, thereto, the above-described polysiloxane was so sprayed as to be in a proportion of 10% by weight. The resulted fine particles were named 'Inorganic fine particles C'. In the inorganic fine particles C, the average particle Size of the primary particles was 12mμm and the specific surface area thereof obtained in a BET method was 93 $m^2/g$.

(4) Inorganic fine particles D (for the comparison)

Silica fine particles, 'Aerosil 200' manufactured by Nippon Aerosil Co., were put into a closed Henshel mixer heated to 100° C. and were then stirred at a high speed while spraying thereto a solution having a viscosity of 1200 cps and an amino equivalent of 3500, which was prepared by dissolving an amino group-containing silicone oil into isopropyl alcohol so that the proportion of the amino group-containing silicone oil might be 2.0% by weight. Next, the resulted matter wad dried up at a temperature of 150° C., so that there obtained the comparative inorganic fine particles which were surface-treated with the amino group-containing silicone oil. The resulted inorganic fine particles are named 'Inorganic fine particles D'.

(5) Inorganic fine particles E (for the comparison)

Silica fine particles, 'Aerosil 200' manufactured by Nippon Aerosil Co., were put into a closed Henshel mixer heated to 70° C. and were then stirred at a high speed while spraying thereto a solution which was prepared by dissolving a γ-aminopropyltriethoxy silane, i.e.. an amino group-containing silane coupling agent into alcohol so that the proportion of the amino group-containing silane coupling agent might be 5.0% by weight. Next, the resulted matter wad dried up at a temperature of 220° C., so that there obtained the comparative inorganic fine particles which were surface-treated with the amino group-containing silane coupling agent. The resulted inorganic fine particles are named 'Inorganic fine particles E'.

(Preparation of carrier)

(1) Carrier C1

Eight parts by weight of silicone varnish, SR02101 manufactured by Toray Silicone Co., were coated by spraying to 100 parts by weight of globular-shaped copper-zinc ferrite particles, manufactured by Japan Iron Powder Co., by making use of a fluidization-bedding apparatus and the resulted particles were further heated at 200° C. extending over 5 hours to be sintered. Next, the resulted coagulation were filtrated, so that there prepared the carrier coated with a layer comprising the sintered matter of silicone varnish. The resulted carriers are named 'Carriers C1'. The average particle size of the carrier C1 was 102 μm.

(2) Carrier C2

Carrier coated with a layer comprising the sintered matter of silicone rubber were prepared in the same manner as in the preparation of Carrier C1, except that 5 parts by weight of silicone rubber, 'SH-2047' manufactured by Toray Silicone Co., 0.05 parts by weight of benzoyl peroxide and 100 parts by weight of globular-shaped copper-zinc ferrite particles manufactured by Japan Iron Powder Co. were used. The resulted carrier is named 'Carrier C2'. The average particle size thereof was 81 μm.

(3) Carrier C3

Six grams of vinylidene fluoride-ethylene tetrafluoride copolymer having a copolymerization mol percentage of 80:20 and an intrinsic viscosity of 0.95 dl/g. 'VT-100' manufactured by Dakin Industrial Co. and 6 g of methyl methacrylate copolymer, 'Acrypet MF' manufactured by Mitsubishi Rayon Co. were dissolved in 500 ml of a mixed solvent having a mixing volume ratio of 1:1 consisted of acetone and methylethylketone, so that a coating solution was prepared. The resulted coating solution was coated, by making use of a fluidization bedding apparatus, to 1 kg of magnetic particles comprising globular-shaped copper-zinc ferrite particles and the coated particles were further heated at 200° C. extending over 5 hours. Next, the resulted coagulation was filtrated, to prepare a carrier coated with the layer having a thickness of about 2 μm. The resulted carrier is named 'Carrier C3'. The average particle size thereof was 82 μm.

(4) Carrier C4

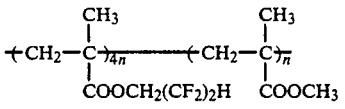

(wherein n is an integer)

The polymer represented by the above-given Formula of 15 g was dissolved in 500 ml of a mixed solvent having a mixing volume ratio of 1:1 consisted of acetone and methylethylketone, so that a coating solution was prepared. The resulted coating solution was coated, by making use of a fluidization bedding apparatus, to 1 kg of magnetic particles comprising globular-shaped copper-zinc ferrite particles and the coated particles were further heated at 200° C. extending over 5 hours. Next, the resulted coagulation was filtrated, to prepare a carrier coated with the layer having a thickness of about 2 μm. The resulted carrier is named 'Carrier C4'. The average particle size thereof was 80 μm.

(5) Carrier C5

Non-resin-coated globular-shaped ferrite particles, 'F-150' manufactured by Japan Iron Powder Co. is named Carrier C5. The average particle size thereof is 105 μm.

(Preparation of toners)

(1) Toner 1

One-hundred parts by weight of a polystyrene-n-butyl acrylate copolymer having a copolymerization ratio by weight of 82:18, 5 parts by weight of carbon black '#30' manufactured by Mitsubishi chemical Industry Co., 2 parts by weight of a charge-controlling agent, 'Nigrosine SO' manufactured by Orient Chemical Co.. and 3 parts by weight of polyolefin. 'Viscol 660P' manufactured by Sanyo Chemical Industry Co. were mixed up with a V type blender and the mixture was then fused with kneading by making use of a couple of rollers. After the fused mixture was cooled down, it was coarsely crushed by making use of a hammer mill and then finely pulvelized by making use of a jet-mill. Next, the pulvelized mixture was classified by making use of a pneumatic classifier, so that a toner having the average particle size of 11.0 μm were obtained. The toners are named Toner 1.

(2) Toner 2

Toner 2 having an average particle size of 11.1 μm was prepared in the same manner as in the preparation of Toner 1, except that there used a composition of 10 parts by weight of carbon black, 'Mogal L' manufactured by Cabbot Co., 3 parts by weight of polyolefin, 'Viscol 660P' and 100 parts by weight of polyester resin obtained by reacting terephthalic acid, polyoxypropylene (2,2)-2,2-bis(4-hydroxyphenyl)propane and trimelitic acid in a mol ratio of 0.7:1:0.3), at 200° C., with a dibutyryl tin oxide catalyst.

(Preparation of developer)

According to the composition shown in the following Tables 1 and 2, the above-described toner and inorganic fine particles were mixed up by making use of a Henshel mixer so as to make the inorganic fine particles adhere to the surfaces of the toner and, thereto the above-described carrier was further mixed in, to prepared an electrostatic latent image developer of the invention that was a two-component type developer.

TABLE 1

| | | Inorganic fine particle | Toner 1 | | Carrier |
|---|---|---|---|---|---|
| Developer-1 | A | 0.5 wt. parts | 50 wt. parts | C 5 | 950 wt. parts |
| Developer-2 | B | 0.4 wt. parts | 50 wt. parts | C 5 | 950 wt. parts |
| Developer-3 | C | 0.6 wt. parts | 50 wt. parts | C 5 | 950 wt. parts |
| Comparative Developer-1 | D | 0.5 wt. parts | 50 wt. parts | C 5 | 950 wt. parts |
| Comparative Developer-2 | E | 0.5 wt. parts | 50 wt. parts | C 5 | 950 wt. parts |

TABLE 2

| | | Inorganic fine particle | | Toner | | Carrier |
|---|---|---|---|---|---|---|
| Developer-4 | A | 0.5 wt. parts | 1 | 50 wt. parts | C 1 | 950 wt. parts |

TABLE 2-continued

| | Inorganic fine particle | | Toner | | Carrier | |
|---|---|---|---|---|---|---|
| Developer-5 | B | 0.4 wt. parts | 1 | 50 wt. parts | C 2 | 950 wt. parts |
| Developer-6 | C | 0.6 wt. parts | 2 | 50 wt. parts | C 3 | 950 wt. parts |
| Developer-7 | A | 0.5 wt. parts | 2 | 50 wt. parts | C 4 | 950 wt. parts |
| Comparative Developer-3 | D | 0.5 wt. parts | 1 | 50 wt. parts | C 1 | 950 wt. parts |
| Comparative Developer-4 | E | 0.5 wt. parts | 1 | 50 wt. parts | C 1 | 950 wt. parts |

Practical copying test

Practical copying test under the conditions of high temperature and humidity Under the conditions of a high temperature of 30° C. and a high humidity of 80%RH and by making use of a modified electrophotographic copying machine, 'U-Bix 1550MR' manufactured by Konishiroku Photo Ind. Co., Ltd., equipped with an organic photoreceptor for forming negative electrostatic latent images, a contact magnetic brush type developing unit and a cleaning unit having a cleaning blade comprising urethane rubber, the practical copying tests were tried to form copied images extending over 50,000 times repeatedly with the above-described developers 1 to 3 and the comparative developers 1 and 2 with the interruption for 5 hours every time when 50,000 copies were made, respectively. The following items were then evaluated. The results thereof are shown in the following Table 3.

Further, by making use of developers 4 to 7 each containing resin-coated carrier, the comparative developers 3 and 4 and the developer 1 containing not-resin-coated carrier, the practical copying tests were tried extending over 100,000 times repeatedly to for copied images in the same manner as mentioned above, respectively. The results thereof are shown in Table 4.

The above-described organic photoreceptor is comprised of a rotary-drum shaped aluminium electroconductive support laminated thereon with a double-layered negatively-chargeable photoreceptive layer formed by making use of an anthanthrone type pigment as a carrier generating substance and a carbazole derivative as a carrier transport substance.

In the above-mentioned tests, the surface potential (i.e., a maximum potential) at the time of charging an organic photoreceptor was −700V, the gap (i.e., Dsd) in a development space between the photoreceptor and a developing sleeve was 0.42 mm, the distance (i.e., Hcut) from the edge of a regulating blade to a developing sleeve was 0.40 mm, a magnetic flux density of a fixed type magnet on the surface of the developing sleeve was 800 Gauss, and the bias voltage applied to the developing sleeve was −150V, A.C.

(1) Fogginess

With respect to each copied image, the relative density to the white background thereof having an original document density of 0.0 was measured with a 'Sakura Densitometer' manufactured by Konishiroku Photo Ind. Co., Ltd. The results of the measurements were evaluated. In the evaluation, the white background density was regarded as 0.0. The results of the evaluation were graded A when the relative density was less than 0.01, B when it was from not less than 0.01 to less than 0.03, and C when it was not less than 0.03, respectively.

(2) Charge when getting started

With respect to the copied images obtained after the copying operation was interrupted at every time when 5,000 copies were made, every evaluation of this item was made on the fogginess thereof mentioned in the above Item (1).

(3) Image quality

The copied image qualities were judged with the eye from the viewpoint of sharpness. The results of the evaluation was graded C when an image was poor and had a problem in practical use, B when it was applicable to practical use. though it was somewhat poor, and A when it was good.

(4) Toner scattering

The inside of a copying machine and the copied images were observed with the eye. The results of the evaluation was graded A when there was little toner scattering and the images were good, B when a few toner scattering were found, but the images were in the level of putting into practical use, and C when many toner scattering were observed and the images had a problem in practical use.

(5) Cleaning property

After images were repeatedly formed, the surface of the photoreceptor used was observed with the eye immediately after the surface was cleaned up with a cleaning blade so that the cleaning property was judged by checking up on adhered matters and scratches on the surface of the photoreceptor. The results of the evaluation were graded A when few adhered matters and scratches were found and the image was good. B when some adhered matters and scratches were found, but the image was in the practically usable level, and C when many adhered matters and scratches were found and the image had a problem in practical use.

(6) Durability of developer

Durability of developer was ranked in order of the numbers of sharp copies obtained from an image.

(7) Magnetic brush trace and blurry copy

A linear density difference appeared on an image was judged with the eye. The results of the evaluation were graded A when it was acceptable, B when it was somewhat poor, and C when it was poor.

(8) Gradation

A chart having 10 steps of an original image density, namely, 0.0, 0.1, 0.2, 0.3, 0.4, 0.5, 0.6, 0.7, 1.0 and 1.25 was made out and was then copied 100,000 times repeatedly. After then, with respect to the 100,000th copy, the gradation thereof were ranked according to how many steps of gradation could be verified.

(9) Resolving power

In accordance with JIS Z 4916 and by making use of a chart having the groups of horizontal lines, 4.0 lines, 5.0 lines, 6.3 lines and 8.0 lines per millimeter, each having the respectively equal intervals, the resolving power of a copy is represented by the grades in which a certain group of horizontal lines could be discriminated.

TABLE 3

| Conditions: At a high temperature of 30° C. and a high humidity of $80^5$ RH | | | | | | |
|---|---|---|---|---|---|---|
| Developer | Fog | Charge getting started | Image quality | Toner flying | Cleaning property | Durability of developer |
| Developer 1 | A/ 50000th | A/ 50000th | A/ 50000th | A/ 50000th | A/ 50000th | A/ 50000th |
| Developer 2 | A/ 50000th | A/ 50000th | A/ 50000th | A/ 50000th | A/ 50000th | A/ 50000th |
| Developer 3 | A/ 50000th | A/ 50000th | A/ 50000th | A/ 50000th | A/ 50000th | A/ 50000th |
| Comparative developer 1 | C/ 20000th | C/ 5000th | C/ 20000th | C/ 25000th | C/ 25000th | C/ 20000th |
| Comparative developer 2 | C/ 30000th | C/ 10000th | C/ 30000th | C/ 35000th | C/ 35000th | C/ 30000th |

TABLE 4

| Conditions: At a high temperature of 30° C. and a high humidity of $80^5$ RH | | | | | | |
|---|---|---|---|---|---|---|
| Developer | Fog | Magnetic brush trace | Charge getting started | Blurry copy | Image quality | Toner scattering |
| Developer 4 | A/ 100000th | A/ 100000th | A/ 100000th | A/ 100000th | A/ 100000th | A/ 100000th |
| Developer 5 | A/ 100000th | A/ 100000th | A/ 100000th | A/ 100000th | A/ 100000th | A/ 100000th |
| Developer 6 | A/ 100000th | A/ 100000th | A/ 100000th | A/ 100000th | A/ 100000th | A/ 100000th |
| Developer 7 | A/ 100000th | A/ 100000th | A/ 100000th | A/ 100000th | A/ 100000th | A/ 100000th |
| Comparative developer 3 | C/ 30000th | C/ 10000th | C/ 10000th | C/ 30000th | C/ 30000th | C/ 40000th |
| Comparative developer 4 | C/ 35000th | C/ 20000th | C/ 15000th | C/ 35000th | C/ 35000th | C/ 40000th |
| Developer 1 | C/ 60000th | C from initial stage | C/ 55000th | B/ 10000 to 50000th C/ 50000 to 100000th | C/ 60000th | C/ 60000th |

| Developer | Cleaning property | Durability of developer | Gradation | Resolving power (line/mm) |
|---|---|---|---|---|
| Developer 4 | A/ 100000th | A/ 100000th | 10 steps | 8.0 ls/mm/ 100000th |
| Developer 5 | A/ 100000th | A/ 100000th | 10 steps | 8.0 ls/mm/ 100000th |
| Developer 6 | A/ 100000th | A/ 100000th | 10 steps | 8.0 ls/mm/ 100000th |
| Developer 7 | A/ 100000th | A/ 100000th | 10 steps | 8.0 ls/mm/ 100000th |
| Comparative developer 3 | C/ 30000th | C/ 30000th | 7 steps | 6.3 ls/mm/ 10000th, 5.0 ls/mm/ 10000 to 30000th, 4.0 ls/mm/ 30000 to 100000th |
| Comparative developer 4 | C/ 40000th | C/ 35000th | 7 steps | 6.3 ls/mm/ 15000th, 5.0 ls/mm/ 15000 to 40000th, 4.0 ls/mm/ 40000 to 100000th |
| Developer 1 | C/ 60000th | C/ 60000th | 6 steps | 6.3 ls/mm/ 10000th, 5.0 ls/mm/ 10000 to 50000th, 4.0 ls/mm/ 50000 to |

TABLE 4-continued

| Conditions: At a high temperature of 30° C. and a high humidity of 80% RH |
|---|
| 100000th |

As is understandable from Tables 3 and 4, even in the environmental conditions of high temperature and humidity. the frictional chargeability and fluidity of toners are excellent when using the developers 1 through 4 of the invention. In a developing process, therefore, a negatively charged electrostatic latent image formed on an organic photoreceptor in a magnetic brush type developing method may excellently be developed without causing any fog or toner flying and, even after an interruption of copying operation, a chargeing is excellent in getting started and no fog is produced. Further, in a cleaning process, an excellent cleaning may be performed with a simply structured cleaning blade. Resultingly, the developers 1 through 4 of the invention are excellent developers capable of providing sharp image quality without producing any fog and toner flying and are also providing excellent durability to obtain sharp images even when they are used for a long period of time.

Further, when using the developers 4 through 7 of the invention comprising the aforementioned resin-coated carrier, neither magnetic brush traces nor blurry images are produced and the gradation and resolving power may be excellent, so that stable and excellent images may be obtained extending over a long period of time.

In addition to the above, another series of durability tests were tried 50,000 times, totaling 150,000 times, by making use of the developers 6 and 7 of the invention comprising the aforementioned fluororesin-coated carriers, it was found that they were particularly high in durability without producing any fog and excellent also in the other characteristics.

In contrast to the above, when using the comparative developers 1 and 3, the frictional chargeability of toner was deteriorated and, resultingly, many fog were produced after a copying interruption, and durability was lowered, so that unsharp images came out in the early stages, because they used the comparative inorganic fine particles D of which the surfaces were treated with an amino group-containing silicone oil.

Further, when using the comparative developers 2 and 4, which used the comparative inorganic fine particles E of which the surfaces were treated with an amino group-containing silane coupling agent, it was difficult to completely cover the surfaces of the inorganic fine particles with the amino group-containing silane coulling agent. Therefore, the negatively charged sites and hydrophilic sites of the inorganic fine particles remained as they were and, resultingly, the frictional chargeability of toners became deteriorated, so that many fog were produced and unsharp images came out.

In addition to the above, when the comparative developers 3 and 4 were used, magnetic brush traces and blurry images appeared on images and, further, the gradation and resolving power of the images were also deteriorated.

Also, when the developer 1 not comprising any resin-coated carrier was used, fog, the other fog produced after an interruption of copying operation, toner scattering and faulty cleaning were found after the 50,000th test. Further, magnetic brush traces and blurry images were also produced, and the gradation and resolving power thereof were also deteriorated.

What is claimed is:

1. A developer for developing an electrostatic latent image comprising toner particles; and 0.1 to 5 percent by weight relative to said toner particles of inorganic fine particles surface treated with a polysiloxane having a repeating unit represented by

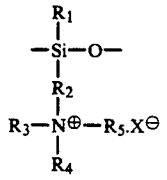

wherein $R_1$ is a hydrogen atom, a hydroxyl group, an alkyl group, an aryl group, an alkoxy group or a

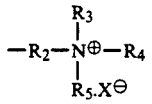

group, $R_2$ is a divalent linkage group or a linkage valence, $R_3$, $R_4$ and $R_5$ independently represent a hydrogen atom, an alkyl group, or an aryl group, X represents a halogen atom, provided that $R_1$, $R_2$, $R_3$, $R_4$ and $R_5$ may independently have a substituent.

2. The developer of claim 1 further comprising carrier particles.

3. An image forming method comprising forming a toner image by developing an electrostatic latent image on a photoreceptor with a particulate developer, transferring said toner image to transfer paper, and scraping away remaining toner, wherein said particulate developer comprises toner particles; and 0.1 to 5 percent by weight relative to said toner particles of inorganic fine particles surface treated with a polysiloxane having a repeating unit represented by

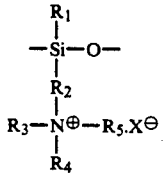

wherein $R_1$ is a hydrogen atom, a hydroxyl group, an alkyl group, an aryl group, an alkoxy group or a

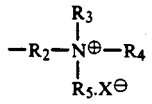

group, $R_2$ is a divalent linkage group or a linkage valence, $R_3$, $R_4$ and $R_5$ independently represent a hydrogen atom, an alkyl group, or an aryl group, X represents a halogen atom, provided that $R_1$, $R_2$, $R_3$, $R_4$ and $R_5$ may independently have a substituent.

4. The developer of claim 1, wherein said polysiloxane has a repeating unit represented by general formula (B);

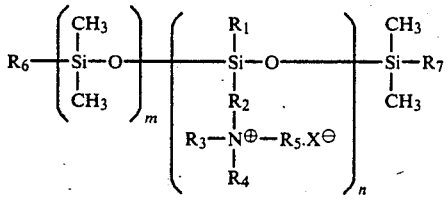

(B)

wherein $R_1$ is a hydrogen atom, a hydroxyl group, an alkyl group, an aryl group, an alkoxy group or a

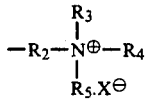

group, $R_2$ is a divalent linkage group selected from the group consisting of an alkylene group, an arylene group, an aralkylene group, a —NH—group, a —NH-CO—group or any combination thereof, or a linking valence, $R_3$, $R_4$ and $R_5$ independently represent a hydrogen atom, an alkyl group, or an aryl group, provided that $R_1$, $R_2$. $R_3$, $R_4$ and $R_5$ may independently have a substituent, $R_6$ and $R_7$ independently represent a hydrogen atom, a hydroxyl group, an alkyl group, an aryl group or an alkoxyl group, provided these groups may have a substituent, X represents a halogen atom, and m and n are respectively integers not less than 1.

5. The developer of claim 1, wherein the primary average diameter of said inorganic particles is 3 mμm to 2μm.

6. The developer of claim 1, wherein BET specific surface area of said inorganic particles is 20 to 500 $m^2/g$.

7. The developer of claim 4, wherein said inorganic particles are substantially made of silica.

8. The developer of claim 2, wherein said polysiloxane has a repeating unit represented by general formula (B);

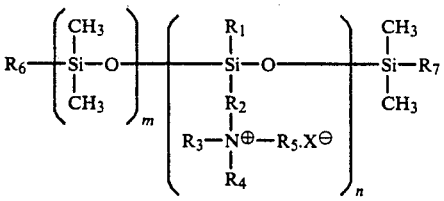

(B)

wherein $R_1$ is a hydrogen atom, a hydroxyl group, an alkyl group, an aryl group, an alkoxy group or a

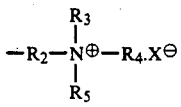

group, $R_2$ is a divalent linkage group selected form the group consisting of an alkylene group, an arylene group, an aralkylene group, a —NH— group, a —NH-CO— group or any combination thereof, or a linking valence, $R_3$, $R_4$ and $R_5$ independently represent a hydrogen atom, an alkyl group, or an aryl group, provided that $R_1$, $R_2$, $R_3$, $R_4$ and $R_5$ may independently have a substituent, $R_6$ and $R_7$ independently represent a hydrogen atom, a hydroxyl group, an alkyl group, an aryl group or an alkoxyl group, provided these groups may have a substituent, X represents a halogen atom, and m and n are respectively integers not less than 1.

9. The developer of claim 2, wherein the primary average diameter of said inorganic particles of which surfaces are treated is 3 mμm to 2 μm.

10. The developer of claim 2, wherein BET specific surface area of said inorganic particles of which surfaces are treated is 20 to 500 $m^2/g$.

11. The developer of claim 2, wherein said inorganic particles are substantially made of silica.

12. The developer of claim 2, wherein said carrier is a resin coated carrier on a material which is capable of being magnetized.

13. The developer of claim 12, wherein said resin is a silicone resin or a fluorinated resin.

14. The developer of claim 12, wherein said material is ferrite.

15. The developer of claim 2, wherein said toner has an average diameter of from 5 μm to 20 μm, and said resin coated carrier has an average diameter of 20 μm to 200 μm.

16. The method of claim 3, wherein said polysiloxane has a repeating unit represented by general formula (B);

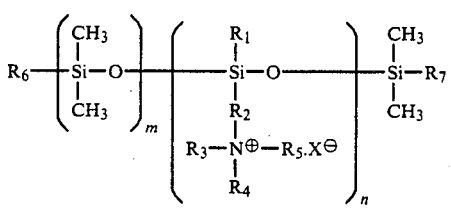

(B)

wherein $R_1$ is a hydrogen atom, a hydroxyl group, an alkyl group, an aryl group, an alkoxy group or a

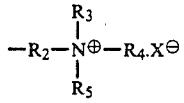

group, $R_2$ is a divalent linkage group selected from the group consisting of an alkylene group, an arylene group, an aralkylene group, a —NH— group, a —NH-CO— group or any combination thereof, or a linking valence, $R_3$, $R_4$ and $R_5$ independently represent a hydrogen atom, an alkyl group, or an aryl group, provided that $R_1$, $R_2$, $R_3$, $R_4$ and $R_5$ may independently have a substituent, $R_6$ and $R_7$ independently represent a hydrogen atom, a hydroxyl group, an alkyl group, an aryl group or an alkoxyl group, provided these groups may have a substituent. X represents a halogen atom, and m and n are respectively integers not less than 1.

17. The method of claim 3, wherein said photoreceptor is an organic photoreceptor.

18. The method of claim 3, wherein the remaining toner on the photoreceptor is removed by scraping with a cleaning blade.

* * * * *